US011596944B2

(12) United States Patent
Madadi et al.

(10) Patent No.: US 11,596,944 B2
(45) Date of Patent: Mar. 7, 2023

(54) MICROFLUIDIC DEVICES WITH BUBBLE DIVERSION

(71) Applicant: QUANTUMDX GROUP LIMITED, Newcastle Upon Tyne (GB)

(72) Inventors: Hojjat Madadi, Newcastle Upon Tyne (GB); Thomas Michael Willshare, Newcastle Upon Tyne (GB); Jonathan O'Halloran, Newcastle Upon Tyne (GB); Philip Thomas Scully, Newcastle Upon Tyne (GB); Paul Marshall, Newcastle Upon Tyne (GB); Eduardo Boada, Newcastle Upon Tyne (GB)

(73) Assignee: QUANTUMDX GROUP LIMITED, Tyne And Wear (GB)

( * ) Notice: Subject to any disclaimer, the term of this patent is extended or adjusted under 35 U.S.C. 154(b) by 397 days.

(21) Appl. No.: 16/756,452

(22) PCT Filed: Oct. 15, 2018

(86) PCT No.: PCT/GB2018/052958
§ 371 (c)(1),
(2) Date: Apr. 15, 2020

(87) PCT Pub. No.: WO2019/077323
PCT Pub. Date: Apr. 25, 2019

(65) Prior Publication Data

US 2020/0298232 A1 Sep. 24, 2020

(30) Foreign Application Priority Data

Oct. 16, 2017 (GB) ..... 1716961

(51) Int. Cl.
*B01L 3/00* (2006.01)

(52) U.S. Cl.
CPC ..... *B01L 3/502746* (2013.01); *B01L 3/502707* (2013.01); *B01L 2200/12* (2013.01);
(Continued)

(58) Field of Classification Search
CPC ..... B01L 2200/0684; B01L 2200/10; B01L 2200/12; B01L 2300/047;
(Continued)

(56) References Cited

U.S. PATENT DOCUMENTS 6,635,226 B1 * 10/2003 Tso ..... G01N 27/44791 422/198
2008/0185043 A1 8/2008 Prins et al.
(Continued)

FOREIGN PATENT DOCUMENTS

CN 105980863 A 9/2016
CN 106470937 A 3/2017
(Continued)

OTHER PUBLICATIONS

International Search Report & Written Opinion, dated Dec. 17, 2018, in International Application No. PCT/GB2018/052958.
Search Report of the United Kingdom Intellectual Property Office, dated Apr. 16, 2018, in GB Application No. GB 1716961.6.
Office Action dated Jun. 21, 2022 in Japanese Application No. 2020-518628.

*Primary Examiner* — Jennifer Wecker
*Assistant Examiner* — Jonathan Bortoli
(74) *Attorney, Agent, or Firm* — Knobbe, Martens, Olson & Bear LLP

(57) ABSTRACT

A microfluidics device has one or more bubble diversion regions. Problems associated with the generation of air bubbles are avoided in a microfluidics device such as a cartridge, for use with a point of care (POC) diagnostics device, the cartridge being able to carry out downstream processing such as polymerase chain reaction (PCR) and/or
(Continued)

nucleic acid capture. The bubble diversion region has a lower flow resistance than the flow resistance of an area of interest.

20 Claims, 7 Drawing Sheets

(52) U.S. Cl.
CPC ..... *B01L 2300/047* (2013.01); *B01L 2300/0848* (2013.01); *B01L 2300/0854* (2013.01); *B01L 2300/0877* (2013.01); *B01L 2300/0883* (2013.01); *B01L 2400/084* (2013.01)

(58) Field of Classification Search
CPC ..... B01L 2300/0848; B01L 2300/0851; B01L 2300/0854; B01L 2300/0877; B01L 2300/088; B01L 2300/0883; B01L 2400/08; B01L 2400/084; B01L 3/502707; B01L 3/502746
See application file for complete search history.

(56) References Cited

U.S. PATENT DOCUMENTS

| | | | | |
|---|---|---|---|---|
| 2015/0101422 | A1 | 4/2015 | Hur et al. | |
| 2015/0209783 | A1 | 7/2015 | Ingber et al. | |
| 2015/0251181 | A1* | 9/2015 | Saito ..... | B01L 3/502723 216/36 |
| 2017/0021354 | A1 | 1/2017 | Kim | |
| 2017/0157606 | A1 | 6/2017 | Kim | |

FOREIGN PATENT DOCUMENTS

| | | | |
|---|---|---|---|
| EP | 1792655 | A1 | 6/2007 |
| EP | 1 855 114 | A1 | 11/2007 |
| EP | 2 985 063 | A1 | 2/2016 |
| JP | 2008520409 | A | 6/2008 |
| JP | 2017508956 | A | 3/2017 |
| JP | 2017122618 | A | 7/2017 |
| JP | 2017519996 | A | 7/2020 |
| WO | WO 2011/050110 | A1 | 4/2011 |
| WO | WO2011050110 | A | 4/2011 |
| WO | WO 2015/188171 | A1 | 12/2015 |

* cited by examiner

MICROFLUIDIC DEVICES WITH BUBBLE DIVERSION

PRIORITY AND CROSS REFERENCE TO RELATED APPLICATIONS

This application is the U.S. National Phase Application under 35 U.S.C. § 371 of International Application PCT/GB2018/052958, filed Oct. 15, 2018, designating the U.S. and published in English as WO 2019/077323 A1 on Apr. 25, 2019, which claims the benefit of Great Britain Application No. GB 1716961.6, filed Oct. 16, 2017. Any and all applications for which a foreign or a domestic priority is claimed is/are identified in the Application Data Sheet filed herewith and is/are hereby incorporated by reference in their entireties under 37 C.F.R. § 1.57.

FIELD

The present disclosure relates to the field of microfluidics devices.

SUMMARY

The present invention relates to a microfluidics device that comprises one or more bubble diversion regions. The present invention is particularly relevant to avoiding problems associated with the generation of air bubbles in a microfluidics device such as a cartridge, for example in a continuous-flow micro-channel, for use with a point of care (POC) diagnostics device, said cartridge being configured to carry out downstream processing such as polymerase chain reaction (PCR) and/or nucleic acid capture etc.

BRIEF DESCRIPTION OF THE DRAWINGS

In order to provide a better understanding of the present invention, embodiments will be described by way of example only and with reference to the following figures in which.

DETAILED DESCRIPTION

Figure 1A:
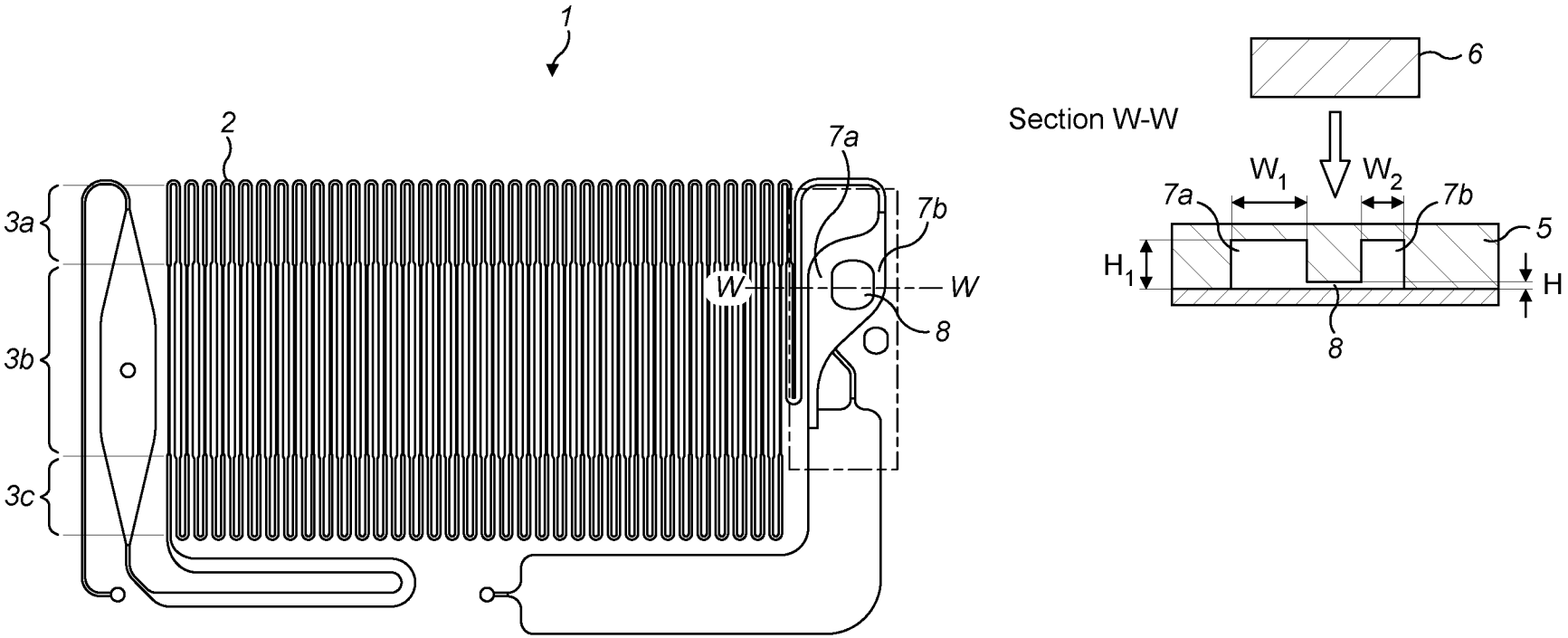
FIG. 1*a* is a diagram of a microfluidic cassette in accordance with the present invention and FIG. 1*b* is a cross section of the bubble diversion region and area of interest.

Microfluidic lab-on-a-chip technology such as microfluidics cassettes can be used for the separation, reaction, mixing, measurement, detection, and so forth of DNA (deoxyribonucleic acid), enzymes, proteins, viruses, cells, and other such biological substances on a substrate that often only measures a few centimeters. Such technology has been gaining prominence in recent years in the fields of medicine, foods, pharmaceuticals, and so on. Various kinds of measurement, detection and the like can be carried out easily and in a short time by allowing a relatively small amount of a sample, such as a blood, serum or sputum sample, to flow into this type of microfluidic device.

Air bubble formation is a significant issue in microfluidic applications. For example, air bubble formation during polymerase chain reaction (PCR) thermo-cycling in a microfluidics channel has been reported as one of the major causes for PCR failure. The formation of air bubbles not only leads to large temperature differences in the sample but also squeezes the sample out of the PCR chamber.

Similarly, air bubble formation can result in further issues either independent of PCR reactions or further downstream of PCR reactions. For example, bubbles can prevent the binding of molecules in areas of interest and/or prevent or restrict the viewing or imaging of areas of interest.

Several methods have been proposed to avoid and inhibit bubble generation in PCR processes in microfluidic systems, including the following options;

(i) The structural design of PCR chamber has been considered with a diamond-shaped or rhomboidal chamber being superior to a circular chamber in preventing bubble formation. Recently, Gong et al. reported that the deeper the PCR chamber, the more difficult it is for the PCR solution to flow into the chamber without trapping bubbles. However, the size of the chamber or the shape and size of the inlet and outlet have little or no influence on the bubble formation.

(ii) The surface treatment of the PCR chamber. In general, the wetting properties of the PCR chamber and its inlet/outlet have an effect on the bubble formation. When the chamber surface is highly hydrophilic, the PCR sample can flow into the chamber smoothly and rapidly without bubble formation, however there are many cases where an entirely highly hydrophilic surface is not appropriate.

(iii) The sealing pressurization of the PCR chamber. Under pressurization and high-temperature, the gas solubility will increase and the dissolved gases and microbubbles in the PCR sample cannot grow up in volume, thus preventing the air bubble formation.

(iv) Degasification of the PCR sample. This process can eliminate non-condensable gases in the PCR sample before loading and consequently decrease the risk of bubble formation).

Similarly bubble traps with micro-porous membranes have been described, for example in US20150209783 and upstream bubble traps that retain bubbles are described in EP17926551. However these bubble traps do then need to deal with retaining the bubbles permanently or removing the bubbles and can only deal with certain volumes of bubbles.

It is notable that these options all look to prevent or restrict the formation of bubbles. Whilst this is useful, there are still many situations where the solutions are not appropriate or in fact where bubbles still form and cause problems. It would be beneficial to provide another option to overcome or mitigate one or more of the problems associated with bubble formation in microfluidics devices.

Throughout this document the term "microchannel" refers to a channel with a hydraulic diameter, in at least one dimension, below 1 mm.

The term "chamber" in this document refers to any chamber in a microfluidic device, such as sample chambers and detection chambers. The term chamber can also refer to a portion of microfluidic channel where a particular activity occurs or with particular characteristics.

The term "fluid communication" refers to a functional connection between two or more areas or chambers that allows fluids to pass between said areas or chambers.

According to the present invention there is provided a microchannel configured to provide a fluid flow path, comprising;

at least one area of interest within said microchannel characterised in that a bubble diversion region is provided adjacent to the area of interest, the bubble diversion region having a lower flow resistance than the flow resistance of the area of interest.

Advantageously, the bubble diversion region is arranged such that any bubbles that are present in a fluid flowing through the microchannel are diverted around an area or areas of interest. For example, a bubble diversion region can be provided adjacent to a microarray where nucleic acids are captured and viewed to ensure bubbles do not either interfere with the binding of nucleic acids to the microarray and/or the viewing of the microarray. As the bubble diversion region acts to divert the bubbles rather than trap and hold them the amount of bubbles is not a limiting factor as they are not held or trapped.

According to an aspect of the present invention there is provided a microfluidics device comprising;

a microchannel formed, at least partially, within a substrate and configured to provide a fluid flow path;

at least one area of interest within said microchannel, characterised in that a bubble diversion region is provided adjacent to the area of interest, the bubble diversion region having a lower flow resistance than the flow resistance of the area of interest.

Preferably, the area of interest is surrounded, on at least one side, by the bubble diversion region, the bubble diversion region having a lower flow resistance than the flow resistance of the area of interest.

In use, fluid flows across the area of interest and the bubble diversion region, with any bubbles present in the fluid flow naturally flowing into the bubble diversion region as it has lower flow resistance than the flow resistance of the area of interest.

The bubble diversion region is in fluid communication with the area of interest.

More preferably the bubble diversion region and area of interest are formed from a single chamber.

Preferably, the microchannel comprises at least one chamber. Most preferably, the area of interest is within the chamber.

Preferably, the bubble diversion region has a greater relative height than the height of the area of interest.

The height, when the chip/cassette is oriented as it would be in use, of the bubble diversion region is greater than that of the area of interest.

Generally, this will also mean that along a given length, the bubble diversion region has a greater cross sectional area than the cross sectional area of the area of interest.

Optionally the microchannel is formed as a groove in a first substrate and a second substrate is overlaid thus enclosing and the microchannel.

Optionally the first substrate is substantially rigid. Preferably the first substrate is substantially planar. Optionally the second substrate is a film.

Preferably the first substrate and second substrate are bonded together.

Preferably the first substrate and second substrate are laser welded together.

Optionally, the first substrate and second substrate are bonded with an adhesive.

Preferably, the bubble diversion region is in the form of one or more grooves in an upper portion of the microfluidic channel.

Optionally, the bubble diversion region is at least partially formed in a plug which is insertable into the first or second substrate, said plug adapted to form at least part of the microchannel.

Optionally the geometry of the bubble diversion area is provided on the surface of the plug that forms part of the microchannel.

Optionally the microfluidic channel is adapted to travel from a first surface of the first substrate, through a first aperture, to the second surface of the first substrate and then return to the first surface via a second aperture.

Optionally the second surface of the first substrate comprises a plug receiving section.

The plug receiving section is adapted to receive a plug in a push fit or friction fit manner and the geometry of the bubble diversion area is provided on the second surface of the first substrate.

Preferably a plug is inserted into the plug receiving section and forms a wall of a portion of the microfluidic channel.

Preferably the bubble diversion region begins upstream of the area of interest.

Optionally the bubble diversion region is on at least part of the boundary of the area of interest.

Preferably the bubble diversion region surrounds both sides of the area of interest.

Most preferably the bubble diversion region is in the form of a plurality of grooves.

Preferably the walls of the bubble diversion region are curved.

It is preferred to have curved walls as opposed to angles or corners as this ensure the fluid flow streamlines and avoids flowing into the corners, termed stagnation zones in fluid mechanics.

Preferably the bubble diversion region ends downstream of the area of interest.

Preferably, downstream of the area of interest the bubble diversion region is configured to direct or allow fluid flow to rejoin the main flow in a downstream microfluidic channel.

Preferably, the bubble diversion region is configured such that at a point downstream of the area of interest, the flow resistance matches the flow resistance of the microfluidic channel. Typically, the geometry of the bubble diversion region is shaped such that at a point downstream of the area of interest the geometry matches that of the rest of the microchannel. This may be that, when downstream of the area of interest, the height of the bubble diversion region is reduced, preferably as a smooth slope, but optionally in a stepped fashion, such that, when the chip/cassette is oriented as it would be in use, it then matches that of microfluidic channel. This ensures that bubbles can be diverted around areas of interest and then can rejoin the main or single flow in a downstream microfluidic channel. This removes the need retain or trap bubbles in a set place and deal with the issues that this brings.

Optionally, the microfluidics device is a continuous flow micro-channel device.

A microfluidics cassette 1, which includes the invention, is shown in FIG. 1. In this embodiment, there is provided a microfluidics cassette 1 with a continuous flow-through micro-channel 2. The micro-channel 2 is formed on the inside of the microfluidic cassette 1, in the desired length and shape so as to allow the passage of a sample, preferably a biological sample in liquid format, along a fluid flow path.

The channel is formed in the upper surface of a first substrate, in this embodiment the first substrate is polycarbonate. The first substrate is overlaid with a second substrate that may itself have grooves formed in its lower surface that can be aligned with the channels of the first substrate. By bonding the substrates together a substantially closed channel is provided (inlets and outlets can be included as required). Any appropriate means of bonding can be used, however laser welding is particularly preferred. Where necessary, the first and second substrates can be aligned prior to bonding. The length and cross sectional shape of the channel can be any appropriate shape to allow for the desired transport and processing of a sample. For example, the micro-channel 2 can have a cross sectional area of about 0.01 $\mu m^2$ to 100 $mm^2$. An area or a portion 3 of, or chamber in, the micro-channel 2 is dedicated to performing PCR such that nucleic acids of interest are amplified. This portion 3 may have annealing 3*a*, extension 3*b* and denaturation 3*c* areas. Then, downstream from the PCR portion 3 of the cassette 1, there is a portion of the channel that forms a microarray chamber 4 that provides for capture of the amplified material. The microarray chamber 4 also allows for the viewing or imaging of the captured material through a viewing surface 5. For example a camera 6 can be aligned with the microarray chamber 4.

Figure 2:
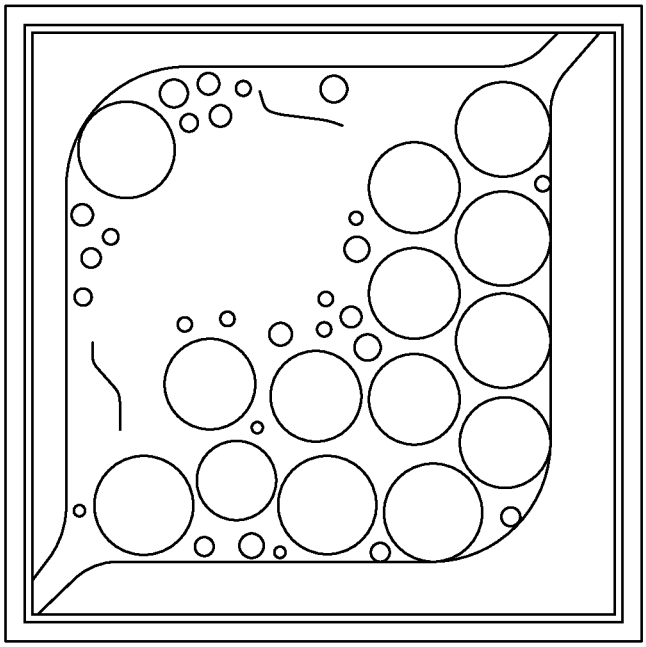
FIG. 2 is a picture of air bubbles distorting the imaging of a micro-array region in a prior art type cassette.

Problems with bubbles can occur when fluid flows through a cassette used in microfluidic applications (which does not utilise the present invention). For example, a picture of air bubbles distorting the imaging of a micro-array region in a prior art type cassette is shown in FIG. 2.

In the present invention, the microarray chamber 4 is provided with bubble diversion regions 7*a,b* in the form or two grooves, or channel extensions that act to divert bubbles 9 that may be present in a sample, or that may form in a sample, away from the area in interest 8 in the microarray chamber 4. In this case the area of interest 8 is the portion of the microarray chamber 4 that captures the amplified material and which will be viewed or imaged.

Figure 1B:
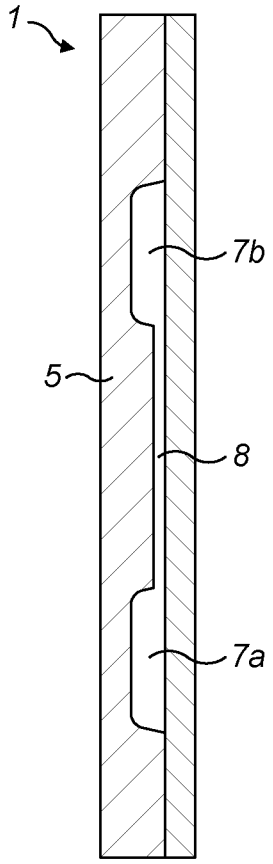

As can be seen in FIG. 1*b*, in this embodiment the bubble diversion region 7 is in the form of two channels or grooves 7*a* and 7*b* that have a greater height (or depth) than the area of interest 8. The height is relative to the material in which the microchannel 2 is formed such that the greater height of the bubble diversion region 7 ensures that, in use, at least a portion of the bubble diversion region 7 is above the area of interest 8. In this embodiment, the depth of the microchannel across the area of interest is 0.17 mm and the bubble diversion regions have a greater depth of 0.9 mm (the bubble diversion regions could, for example, have a depth of approximately 0.6 mm). The greater depth of the bubble diversion regions is configured as additional relative height of said regions compared with the area of interest. As bubbles will naturally rise in fluid, when the chip is in use (and the chip oriented in a manner that the bubble diversion regions are in the upper portion of the channel of chamber) any bubbles present in the fluid will rise to the higher areas, namely the bubble diversion region.

In this embodiment, the bubble diversion region 7*a,b* is formed as two elongate grooves that extend into the upper portion of the microarray chamber 4, which, in this embodiment, is formed in the internally facing surface of the first substrate. The area of interest is also formed in the lower surface of the first substrate but has less depth than the bubble diversion region. It would be understood that whilst during manufacturing of the microchannel the first substrate may be viewed as the bottom or lower substrate with a second substrate being overlaid, in use, the first substrate would typically be positioned above the second substrate. The first substrate may also be transparent or have transparent sections to allow fir viewing of at least portions of the internal microchannel. The grooves take the form of open channels with a substantially rectangular cross section formed by a groove upper wall and first and second groove side-walls. However, it would be appreciated that the groove could be formed by other means and with other configurations e.g. a groove could be provided as a single semi-circular groove.

In this embodiment, the bubble diversion region 7*a,b* begins slightly upstream from the area of interest 8 and extends around the circumference of the area of interest 8. The point where the bubble diversion region 7*a,b* begins can be varied based on the required space and also application. The general purpose is to divert the bubbles from the area of interest and let them back into the flow after this region. Therefore, this design does not permanently trap the bubbles it simply substantially prevents them from flowing across or into the area of interest.

Figure 3:
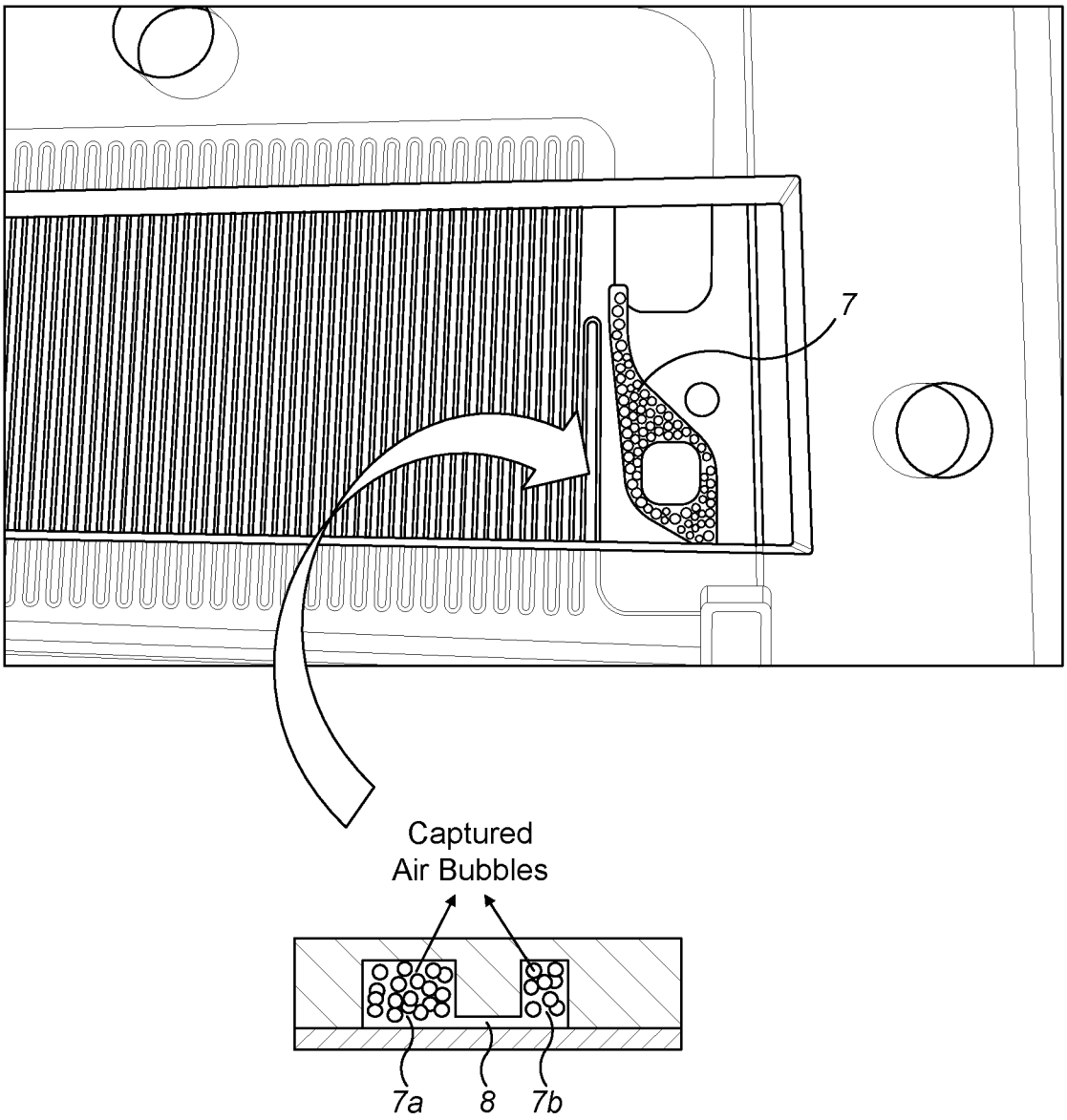
FIG. 3 is an image showing a cassette in accordance with the present invention with bubbles diverted around an area of interest.

It will be understood that with this invention, bubbles may still be generated in the system. For example, in the embodiment above, the PCR mixture including amplified material of interest along with generated air bubbles all reaches the microarray chamber 4. Since the flow resistance of the bubble diversion regions 7*a,b* on both side of the microarray are less than the flow resistance of the area of interest 8, the fluid including air bubbles flows around the area of interest 8. Furthermore, the air bubbles physically move towards the upper layer of fluid flow as the bubble diversion channels have at least a portion higher than the microarray chamber 4. The bubbles preferentially flow into the bubble diversion regions and substantially avoid the area of interest 8 as can be seen in FIG. 3.

A symmetrical bubble diversion region has two substantially parallel and equally sized grooves or extended channels circumventing or bounding the area of interest. Although a symmetrically designed bubble diversion region is often preferred to allow for smooth fluid flow, an asymmetrically designed groove or channel can be used where there is a space limitation, for example at one side of a microarray. The volume of the bubble diversion region can be selected depending on the flow and perceived likely volume of bubbles. It is possible to capture and retain more volume of generated bubbles in bubble diversion regions with a larger area or volume and consequently there is less chance of trapping air bubbles on the microarray surface where relatively larger bubble diversion regions are used.

Notably, due to the dimensions of the bubble diversion regions, the flow resistance in the bubble diversion region is lower than the flow resistance in the area of interest e.g. the microarray chamber. Generally in microfluidics, flow rate Q in a channel is proportional to the applied pressure drop ΔP. This can be summarized in $$\Delta P = RQ$$

with the R, hydrodynamic resistance. This expression is formally the analogy of the electrokinetic law between voltage difference and current, V=RI.

The expression for the hydraulic resistance is:

channel of circular cross-section (total length L, radius R):

$$R = \frac{8\mu L}{\pi R^4}$$

rectangular cross-section (width w, b=w/2 and height h, a=h/2)

$$R = \frac{3\mu L}{4ba^3}\left(1 - \frac{192a}{\pi^5 b}\sum_{n=1,3,5}^{\infty}\frac{\tanh\left(\frac{n\pi b}{2a}\right)}{n^5}\right)$$

The analogy of electrical circuits provide useful tools for the design of more complex microfluidics networks. Kirchhoff's laws for electric circuits apply, being modified in that the sum of flow rates on a node of the circuit is zero and the sum of pressure differences on a loop is zero.

Figure 4:
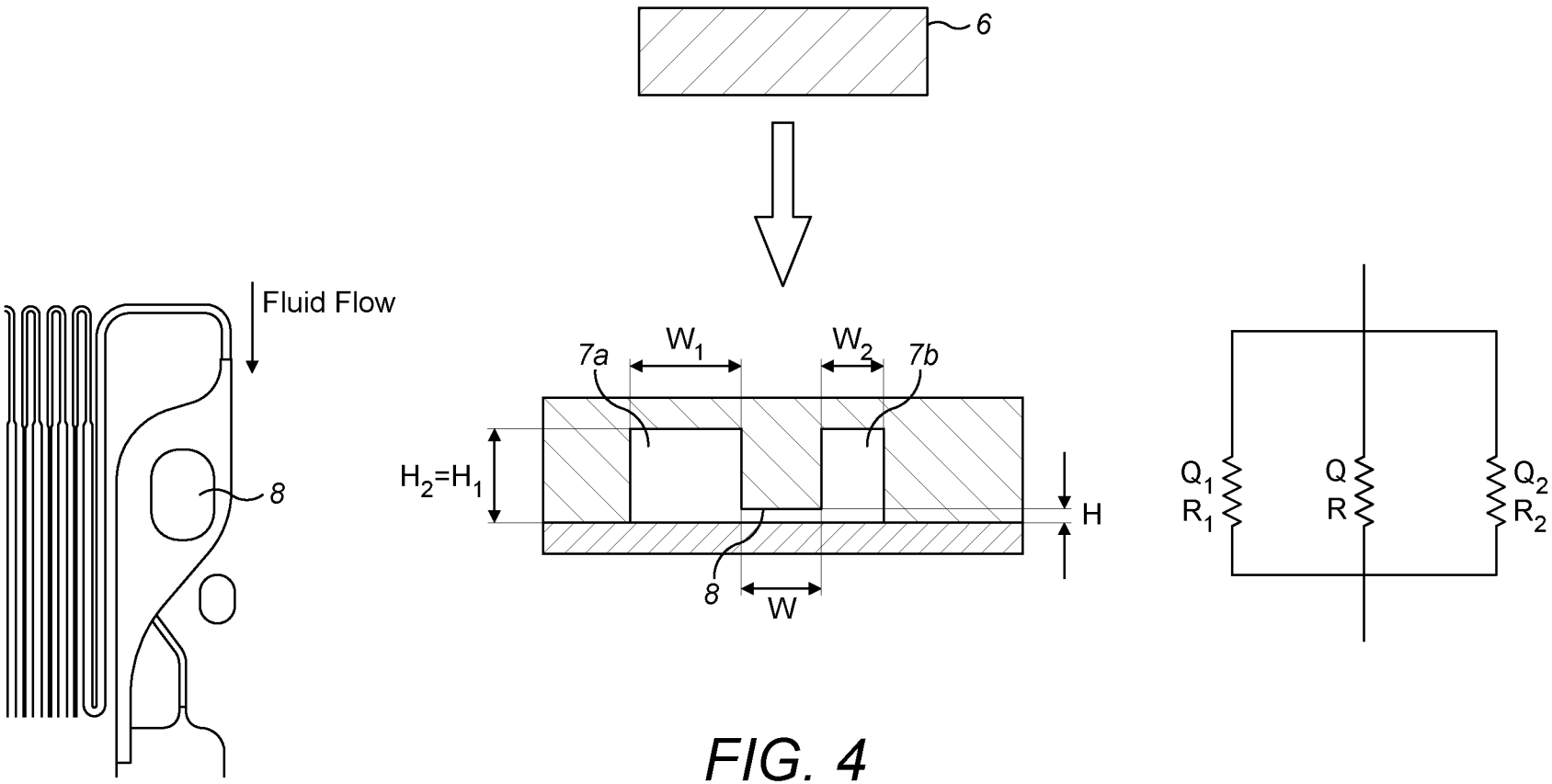
FIG. 4 shows an electrical circuit analogy of a preferred fluidics flow in a cassette according to the present invention.

On this basis, the electrical circuit analogy of a preferred fluidics flow is shown in FIG. 4. As can be seen, the cross section of both microchannels around the microarray ($W_1$, $W_2$, $H_1$, $H_2$) is much bigger than the microarray channel (W,H), which leads to a lower flow resistance in theses microchannels compared microarray channel ($R_1$, $R_2$<R). Therefore, the flow rate of the fluid in the parallel microchannels is higher than the microarray channel ($Q_1$, $Q_2$<Q).

By utilising the explained behaviour of fluid flow, the dragging of air bubbles along the flow and the natural tendency of air bubbles to rise vertically upwards, the air bubbles rise and divert from the area of interest.

Figure 5A:
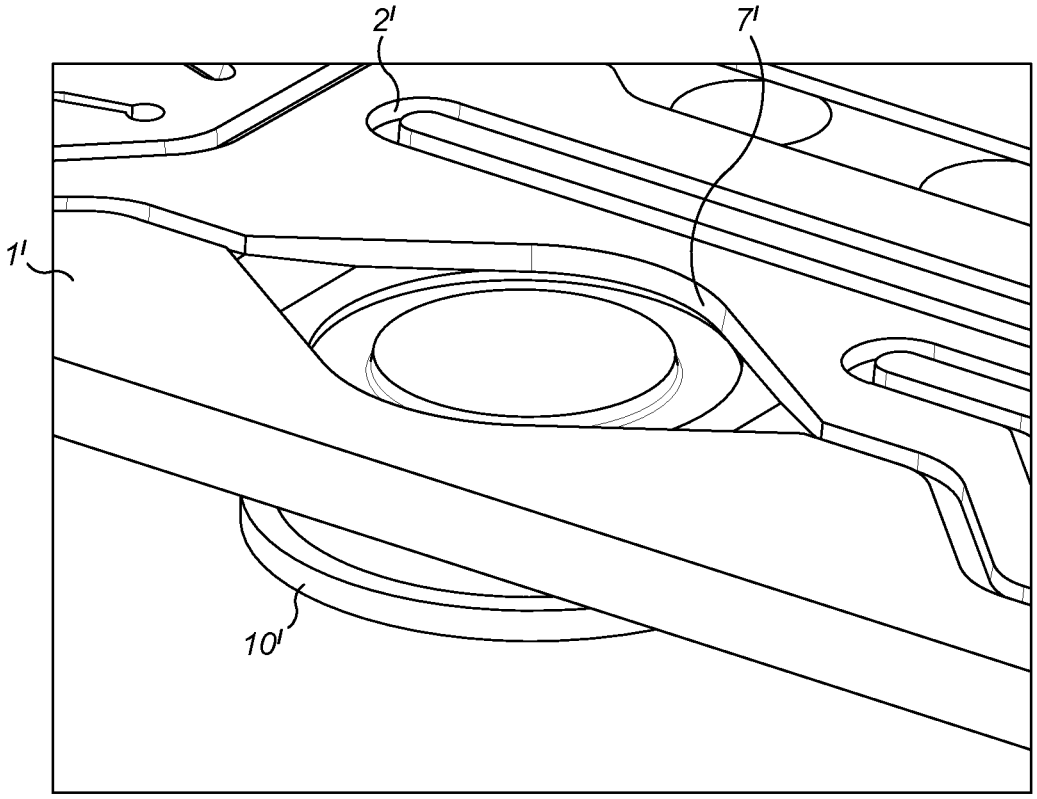
FIG. 5*a* is a diagram of a portion of a microfluidic cassette in accordance with an alternative embodiment of the present invention which incorporates a plug adapted to form at least part of the microchannel.
Figure 5B:
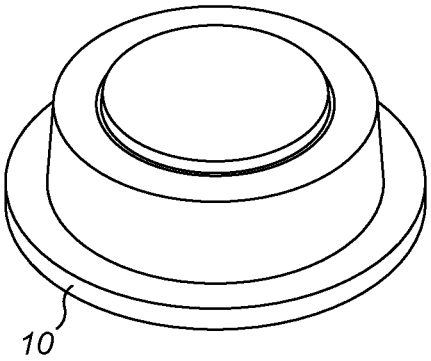
FIG. 5*b* is a diagram of said plug.

Another embodiment of the invention is also envisaged, an example of which is shown in FIGS. 5*a* and 5*b*. Again, there is provided a microfluidics cassette 1' with a continuous flow-through micro-channel 2' and the micro-channel 2' is formed on the inside of the microfluidic cassette 1'. In this embodiment, the cassette comprises a first substrate such as polypropylene, in which the channel is formed. The first substrate is overlaid with a second substrate and the two are bonded together. As such, a substantially closed channel is provided (again inlets and outlets can be included as required). As can be seen in FIG. 5*a*, a portion of the first substrate has an aperture therethrough, into which a plug 10' of the type shown in FIG. 5*b* can be inserted. The surface of the plug 10' then forms part of the upper wall (in use) of the microchannel and is shaped to form bubble diversion region 7'. The plug 10' or a portion thereof could be transparent if it is desirable to view or image the area of interest therethrough.

Figure 6A:
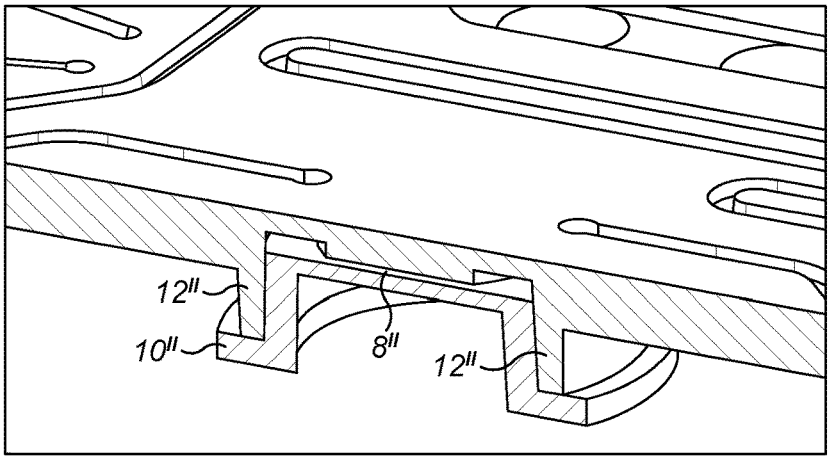
FIGS. 6*a* and 6*b* are diagrams of a portion of a microfluidic cassette in accordance with a further alternative embodiment of the present invention which also incorporates a plug adapted to form at least part of the microchannel and FIG. 6*c* is a diagram of the plug.
Figure 6B:
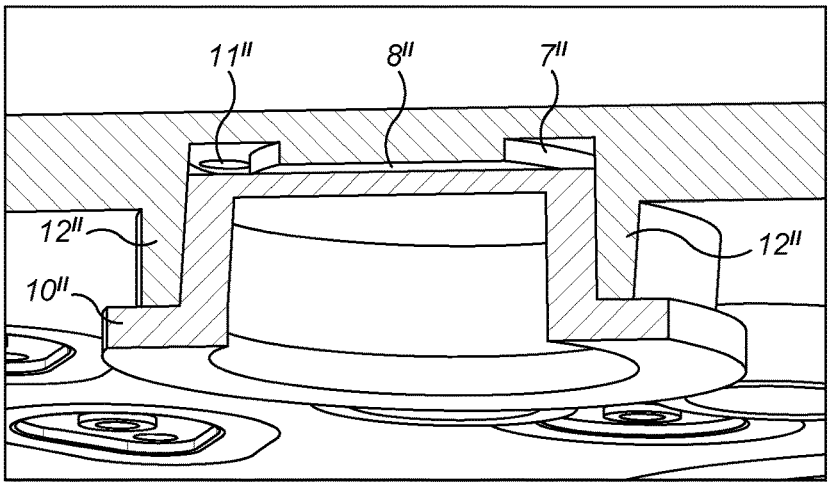
Figure 6C:
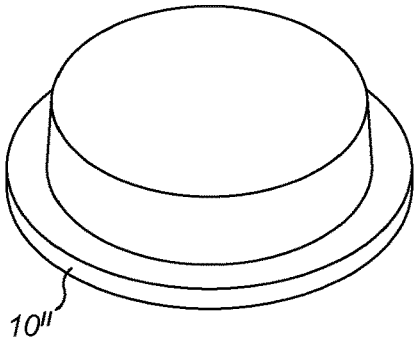

A yet further embodiment of the invention is also shown in FIGS. 6*a*, 6*b* and 6*c*. Again, there is provided a microfluidics cassette 1" with a continuous flow-through microchannel 2" and the micro-channel 2" is formed on the inside of the microfluidic cassette 1". However, in this embodiment, the cassette 1" comprises a first substrate such as polypropylene, in which the channel is formed and a second substrate in the form of a polyproylene film. By bonding the first substrate material to the film, for example using laser welding, a substantially closed channel is provided (again inlets and outlets can be included as required). The first substrate is a planar element with an upper and lower surface, the majority of the microchannel being formed in the upper surface. However, in this case it is often desirable that the second substrate, i.e. the film, forms the upper wall of the microchannel in use. However, as the film is a thin layer it isn't suitable for forming the geometry required for a bubble diversion region. Therefore, in this embodiment, and as can be seen in FIG. 6*b*, the microfluidic channel is adapted to travel from a first surface of the planar element through an aperture 11" in the body of the planar element/substrate to the second surface and then return to the first surface via a second aperture. A plug receiving section 12" which is adapted to receive a plug 10" in a push fit or friction fit manner is associated with the second surface of the cassette and the geometry of the bubble diversion area 7" is provided on the second surface of the cassette. When a plug 10" is inserted into the plug receiving section 11" it forms the lower wall of a portion of the microfluidic channel. In use, fluid enters a chamber formed between the plug 10" and the cassette. The bubble catcher geometry that forms the bubble diversion area 7" is moulded into the microfluidic substrate, and the plug simply has a flat surface, as shown best in FIG. 6*c*. The depth of bubble catcher, and distance between the plug surface and microfluidic substrate remains the same as for other embodiments. The plug embodiment provides an option particularly suited to manufacturing. It would however be understood that the bubble catcher geometry could be moulded into the microfluidic substrate in the same way and the plug portion could be a permanent structure rather than the plug. It will be appreciated that features from one embodiment may be appropriately incorporated into another embodiment unless technically unfeasible to do so.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

It will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A microfluidics device comprising:

a micro-channel configured to provide a fluid flow path, comprising:

at least one area of interest for binding, capturing, imaging, or viewing within the micro-channel, and a bubble diversion region adjacent to the at least one area of interest, the bubble diversion region having a greater height than the height of the at least one area of interest and a lower flow resistance than the flow resistance of the at least one area of interest, a first substrate having a first surface and a second surface opposite the first surface, a second substrate, wherein the second substrate is overlaid the first substrate, wherein the micro-channel comprises a groove in the first substrate, the micro-channel extending from the groove in the first surface of the first substrate to the second surface of the first substrate through a first aperture in the first substrate, and from the second surface of the first substrate to the first surface of the first substrate through a second aperture in the first substrate, wherein the second surface of the first substrate comprises a plug receiving section, and wherein at least a part of a geometry of the bubble diversion area is provided on the second surface of the first substrate.

2. The microfluidics device of claim 1, wherein the at least one area of interest is surrounded, on at least one side, by the bubble diversion region, the bubble diversion region having a lower flow resistance than the flow resistance of the area of interest.

3. The microfluidics device of claim 1, wherein the bubble diversion region is in fluid communication with the at least one area of interest.

4. The microfluidics device of claim 1, wherein the bubble diversion region and area of interest are formed from a single chamber.

5. The microfluidics device of claim 1, comprising at least one chamber.

6. The microfluidics device of claim 5, wherein the at least one area of interest is within the at least one chamber.

7. The microfluidics device of claim 1, wherein the bubble diversion region has a greater relative height than the height of the at least one area of interest.

8. The microfluidics device of claim 1, wherein the bubble diversion region has a greater cross-sectional area than the cross sectional area of the at least one area of interest.

9. The microfluidics device of claim 1, wherein the first substrate and second substrate are bonded together.

10. The microfluidics device of claim 1, wherein the bubble diversion region is in the form of one or more grooves in an upper portion of the microfluidic channel.

11. The microfluidics device of claim 1, wherein the bubble diversion region is at least partially formed in or by a plug which is insertable into the first or second substrate, the plug adapted to form at least part of the microchannel.

12. The microfluidics device of claim 1, wherein the plug receiving section is configured to receive a plug in a push fit or friction fit manner and the geometry of the bubble diversion area is provided on the second surface of the first substrate.

13. The microfluidics device of claim 12, wherein a plug is inserted into the plug receiving section and forms a wall of a portion of the microfluidic channel.

14. The microfluidics device of claim 1, wherein the bubble diversion region begins upstream of the at least one area of interest.

15. The microfluidics device of claim 1, wherein the bubble diversion region is on at least part of the boundary of the at least one area of interest.

16. The microfluidics device of claim 1, wherein the bubble diversion region surrounds both sides of the at least one area of interest.

17. The microfluidics device of claim 1, wherein the bubble diversion region comprises a plurality of grooves.

18. The microfluidics device of claim 1, wherein a wall of the bubble diversion region is curved.

19. The microfluidics device of claim 1, wherein the micro-channel is formed, at least partially, within a substrate and configured to provide a fluid flow path.

20. The microfluidics device of claim 19, wherein the microfluidics device is a continuous flow micro-channel device.

* * * * *